US005785200A

United States Patent [19]

Eriksson

[11] Patent Number: 5,785,200

[45] Date of Patent: Jul. 28, 1998

[54] SEALING DEVICE FOR A CYLINDRICAL PACKAGE OF FLEXIBLE MATERIAL

[76] Inventor: Vilho Eriksson, O. Henriksborgsvagen 45, S-131 31 Nacka, Sweden

[21] Appl. No.: 578,654

[22] PCT Filed: Jul. 8, 1994

[86] PCT No.: PCT/SE94/00677

§ 371 Date: Jan. 31, 1996

§ 102(e) Date: Jan. 31, 1996

[87] PCT Pub. No.: WO95/01847

PCT Pub. Date: Jan. 19, 1995

[30] Foreign Application Priority Data

Jul. 8, 1993 [SE] Sweden ..... 9302371

[51] Int. Cl.[6] ..... B65D 41/04

[52] U.S. Cl. ..... 220/289; 215/329; 220/288; 426/87; 33/700

[58] Field of Search ..... 215/329, 321, 215/317, 318, 353, DIG. 7; 220/288, 289, 296; 33/700, 783; 426/87, 112, 115, 232; 222/23

[56] References Cited

U.S. PATENT DOCUMENTS

| | | | |
|---|---|---|---|
| 1,935,100 | 11/1933 | Paull et al. | 220/289 X |
| 2,804,103 | 8/1957 | Wall | 215/DIG. 7 |
| 2,921,707 | 1/1960 | Sloan | 215/DIG. 7 |
| 3,147,857 | 9/1964 | Eckles | 220/780 X |
| 3,840,143 | 10/1974 | Davis et al. . | |
| 4,566,508 | 1/1986 | Bowyer | 215/DIG. 7 |
| 4,678,098 | 7/1987 | Oka | 220/289 |
| 4,785,952 | 11/1988 | Obadia | 215/329 |
| 5,012,970 | 5/1991 | Kucherer | 220/289 X |
| 5,152,416 | 10/1992 | Cassel | 220/296 X |
| 5,213,225 | 5/1993 | King et al. | 220/296 X |
| 5,596,813 | 1/1997 | Olson, Jr. et al. | 33/783 X |

FOREIGN PATENT DOCUMENTS

| | | | |
|---|---|---|---|
| 1021593 | 2/1953 | France | 215/DIG. 7 |
| 4 005 888 | 10/1990 | Germany . | |

*Primary Examiner*—Allan N. Shoap
*Assistant Examiner*—Nathan Newhouse
*Attorney, Agent, or Firm*—Young & Thompson

[57] ABSTRACT

A combination of a cylindrical container and a closure for containing products in paste form. The closure device has a bottom (3) and an essentially cylindrical wall (4) that joins and extends out from the bottom. The closure has at least two radially inwardly directed ridges (5), which extend helically essentially from the bottom (3) to the free edge of the wall (4). Scale markings on the closure measure a portion of the product in the closure when the closure is partially opened and the container is vertical and sits on the closure.

10 Claims, 2 Drawing Sheets

SEALING DEVICE FOR A CYLINDRICAL PACKAGE OF FLEXIBLE MATERIAL

The invention relates to a closure device for a cylindrical packing of flexible material, said packing being intended for paste products.

Greater and greater demands are being placed on packings being simpler and more environmentally friendly, but combining an environmentally friendly packing with simple use for the user at low price is in many cases very difficult. As regards relatively solid or semisolid products, i.e. products with a paste-like consistency, so-called hose-packings, are used today, which are simple and inexpensive. One problem is, however, that such a packing cannot be reclosed in a simple and satisfactory manner once it has been opened. This means that after use of a portion of the product, it is difficult to store the remaining product in a satisfactory manner.

The purpose of the invention is to remove the above described problem and provide a packing which can be reclosed after a portion of the contents has been removed. This is achieved according to the invention by means of a closure device which has those features claimed herein.

The invention will be described in more detail below with reference to the accompanying drawing, which shows, as an example, a preferred embodiment of the invention and in which:

FIG. 1 shows a cylindrical packing 1, which can be a so-called hose-packing which is known per se. This packing is intended to contain a relatively solid or semisolid product, such as dog or cat food, nut paste, chocolate paste, butter, margarine, liverwurst or other spreadable products.

Figure 1:
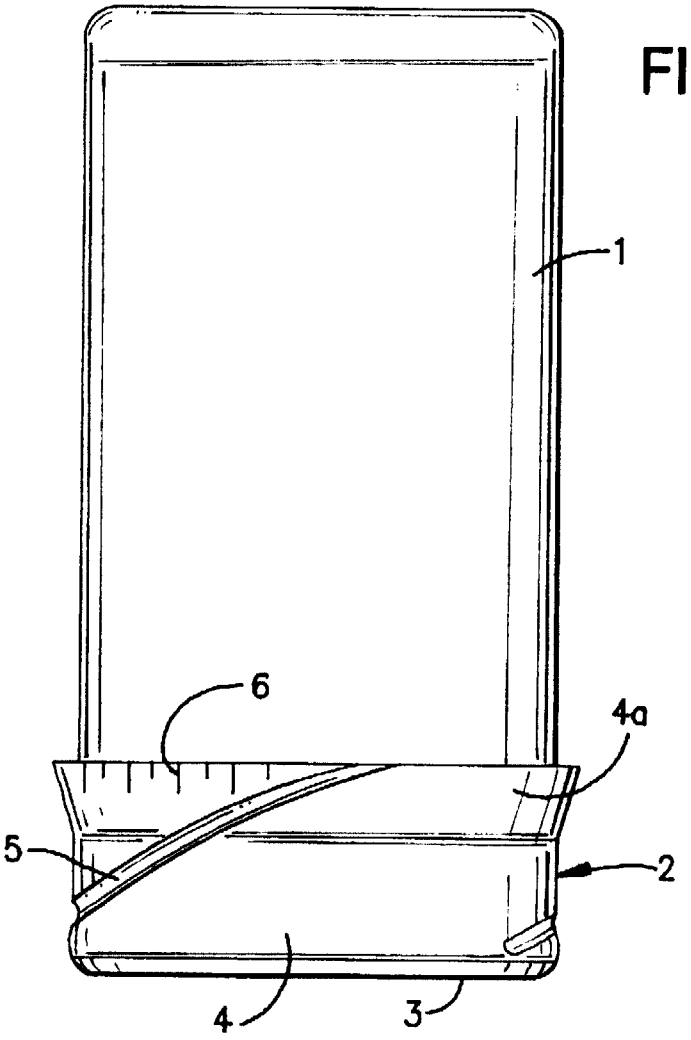
FIG. 1 is a sideview of a closure device according to the invention mounted on a packing.

At the lower end of the packing 1 in FIG. 1, there is a closure device with a closure means 2 according to the invention. The closure means 2 has the shape of an upside down cover with a bottom 3 (see FIGS. 2 and 3) and an essentially cylindrical wall 4, which is made in one piece with the bottom 3 and extends in one direction therefrom.

On its inside, the essentially cylindrical wall 4 is provided with two radially inwardly directed ridges 5, extending helically essentially from the bottom 3 to the free edge of the wall 4. As can be seen, each of the ridges 5 only extends along a portion of the circumference of the wall 4, and the ridges 5 form a short thread with a large pitch angle. It should also be noted that the number of ridges 5 can be greater than 2, e.g. 4, which can be of advantage for achieving stability during use.

Figure 3:
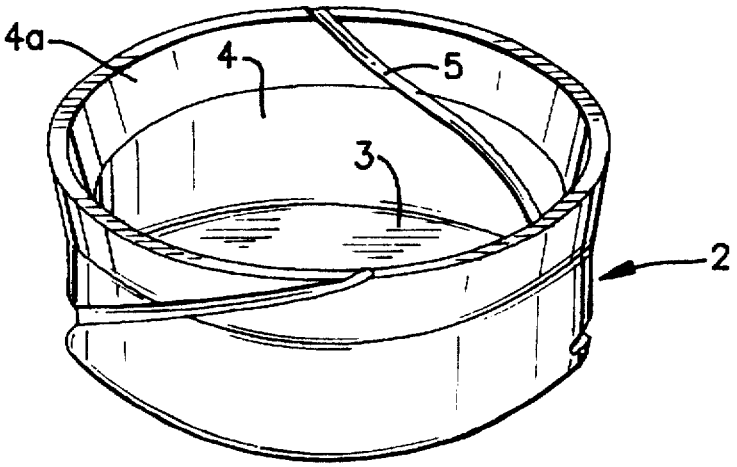
FIG. 3 is a perspective view of the closure device according to FIGS. 1 and 2.

As can be seen in FIGS. 1 and 3, the wall 4 on at least a portion 4*a* closest to the free edge is made slightly conically with a larger diameter at the free edge, i.e. the wall is wider at the top as seen in FIG. 1.

Figure 2:
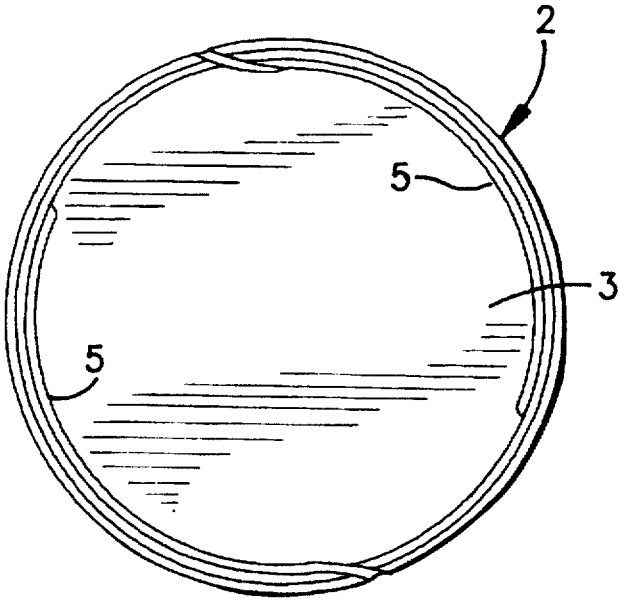
FIG. 2 is a plan view seen from above of the closure device shown in FIG. 1.

As is particularly evident from FIG. 2, the ridges 5 are evenly distributed around the circumference of the inside of the wall 4. The use of three or four ridges is also suitable, which is, however, not shown in the drawing.

The wall 4 is also provided on its outside with scale markings 6, making it possible to measure out a desired amount of the product in the packing 1, as will be described in more detail below.

The closure device according to the invention functions in the following manner. When the packing 1 has been filled with the desired product, the closure means 2 is mounted in place by being screwed onto the flexible material of the packing 1. The ridges 5 produce threads by pressing in the material in the packing 1 in the packaged product. In this manner, the closure means 2 can be securely screwed fast to the packing 1, said screwing being facilitated by the conical portion 4*a* of the wall 4. The pitch of the ridges 5 is suitably selected so that the closure means 2 can be screwed fast onto the packing 1 so that it will come into contact with the bottom 3 after being rotated approximately 120°.

In a corresponding manner, the packing 1 can be reclosed after removal of the closure means 2 and removal of the desired amount of the contents of the packing 1. Reclosure is achieved in a reliable manner by virtue of the fact that the closure means 2 will be in close contact with its wall 4 against the outside of the packing 1. Thus, the contents of the packing 1 will be protected in a satisfactory manner.

With the aid of the scale marking 6 on the outside of the wall 4, it is possible, by turning the closure means 2, to measure out a desired amount of the contents of the packing 1 for removal. The closure means 2 is screwed down completely, whereafter the closure means 2 is screwed back a sufficient number of markings on the scale marking 6 so that the desired volume remains in the closure means 2, a mark is thereafter made in the flexible material of the packing 1, the closure means is screwed off and the packing 1 is cut along the marking. The height of the wall 4 and the distance between the scale marking 6 must be coordinated so that it is possible to judge how great an amount of the contents in the packing 1 there is room for in the closure means 2.

Figure 4:
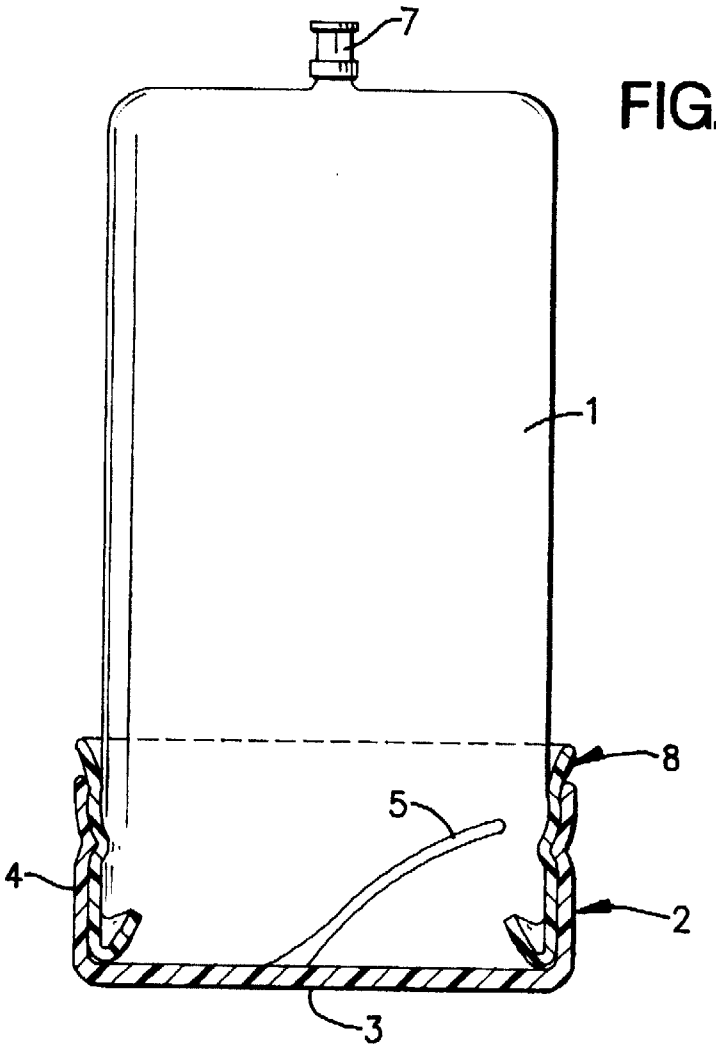
FIG. 4 shows a section through a closure device according to a second embodiment of the invention, mounted on a packing.

FIG. 4 shows a cylindrical packing 1 with a closure device according to a second embodiment of the invention. In this case as well, there is a closure means 2 with a bottom 3 and an essentially cylindrical wall 4, which has radially inwardly directed ridges 5 in the same manner as in the embodiment according to FIGS. 1–3.

In the embodiment according to FIG. 4, there is also an inner closure means 8, which is joined to the packing 1 by means of glueing or in another suitable manner, so that there will be a tight joint between the inner closure means 8 and the packing 1. The closure means 2 is then screwed onto the inner closure means 8.

The embodiment according to FIG. 4 is intended to be used for products which cannot be exposed to air for any longer period of time. The packing 1 is a so-called collapsible packing, which collapses as its contents is used. In its simplest form, this is a hose-packing which is closed at its upper end by a clip 7.

When the packing 1 is filled and unused, the inner closure means 8 is provided with a bottom (not shown in the drawing), providing an airtight seal for the entire lower end of the packing 1. At the first opening of the packing, the bottom of the inner closure means 8 is cut off as well as the end of the packing 1. Then the desired amount of the product is squeezed out of the packing 1, and the closure means 2 is placed onto the inner closure means 8.

The invention is of course not limited to the examples shown above, rather changes can be made within the scope of the following claims.

I claim:

1. A combination of a container for a paste product and a closure therefor, said container comprising a cylinder of flexible material having one closed end and one open end to which said closure is removably attached;

said closure comprising a bottom and a cylindrical wall joined to and extending from said bottom, an internal perimeter of said wall corresponding to an external perimeter of said open end to sealably close said open end when said closure is removably attached to said container; and said wall having at least two radially inwardly directed ridges which extend helically essentially from said bottom to a free end of said wall, said ridges producing corresponding grooves in an exterior of said flexible material and inwardly displacing an interior of said flexible material of said container when said closure is removably attached to said container.

2. The combination of claim 1, wherein said free end of said wall has a larger diameter than said bottom, and wherein said wall tapers inwardly from said free end over at least a portion of a height of said wall.

3. The combination of claim 1, wherein said ridges are evenly distributed around said wall.

4. The combination of claim 1, wherein said open end has a diameter substantially the same as that of said cylinder to facilitate removal of the paste product.

5. A combination of a container for a paste product and a closure therefor, said container comprising a cylinder of flexible material having one closed end and one open end to which said closure is removably attached;

said closure comprising a bottom and a cylindrical wall joined to and extending from said bottom, an internal perimeter of said wall corresponding to an external perimeter of said omen end to sealably close said open end when said closure is removably attached to said container; and said wall having at least two radially inwardly directed ridges which extend helically essentially from said bottom to a free end of said wall, said ridges producing corresponding grooves in an exterior of said flexible material of said container when said closure is removably attached to said container, wherein said wall comprises scale markings around a portion of a periphery thereof, said scale markings indicating an angular displacement of said closure for measuring a portion of the paste product in said closure when said closure is partially removed and said container is vertical with said closed end up.

6. The combination of claim 5, wherein said ridges have a pitch so that said open end of said container contacts said bottom of said closure after said closure is rotated about 120°.

7. A combination of a container for a paste product and a closure therefor, said container comprising a cylinder of flexible material having one closed end and one open end to which said closure is removably attached;

said closure comprising a bottom and a cylindrical wall Joined to and extending from said bottom, an internal perimeter of said wall corresponding to an external perimeter of said open end to sealably close said open end when said closure is removably attached to said container;

said wall having at least two partially inwardly directed ridges which extend helically essentially from said bottom to a free end of said wall, said ridges producing corresponding grooves in an exterior of said flexible material of said container when said closure is removably attached to said container; and a cylindrical inner closure on said open end onto which said closure is removably attached.

8. The combination of claim 7, wherein said cylindrical inner closure comprises a removable bottom for closing said open end.

9. The combination of claim 7, wherein said ridges do not overlap in an axial direction of said wall.

10. A combination of a container for a paste product and a closure therefor, said container comprising a cylinder of flexible material having one closed end and one open end to which said closure is removably attached, said open end having an internal diameter substantially the same as that of said cylinder to facilitate removal of the paste product;

said closure comprising a flat bottom on which the combination is vertically supported with said closed end up, and a cylindrical wall joined to and extending from said bottom, said wall having a free end with a larger diameter than said bottom, and wherein said wall tapers inwardly from said free end while leaving a portion of a height of said wall untapered, an internal perimeter of said untapered portion of said wall corresponding to an external perimeter of said open end to sealably close said open end when said closure is removably attached to said container;

said wall having at least two radially inwardly directed ridges which extend helically essentially from said bottom to a free end of said wall, said ridges producing corresponding grooves in said flexible material of said container when said closure is removably attached to said container; and said wall further comprising scale markings around a portion of a periphery of said free end, said scale markings indicating an angular displacement of said closure for measuring a portion of the paste product which descends into said closure when said closure is partially removed and said container is vertical with said closed end up.

* * * * *